United States Patent [19]

McDonald

[11] 4,363,393

[45] Dec. 14, 1982

[54] COIN CONTROLLED MECHANISM FOR VENDING MACHINE

[76] Inventor: Winford G. McDonald, 128 Hill, Center, Tex. 75935

[21] Appl. No.: 237,502

[22] Filed: Feb. 23, 1981

[51] Int. Cl.[3] ..... G07F 5/04; G07F 11/22

[52] U.S. Cl. ..... 194/63; 194/DIG. 2; 221/273

[58] Field of Search ..... 194/63, 1 G, DIG. 2; 221/273

[56] References Cited

U.S. PATENT DOCUMENTS

| | | | |
|---|---|---|---|
| 1,043,374 | 11/1912 | Travis et al. | 194/93 |
| 1,874,497 | 8/1932 | Gildemeister | 194/DIG. 2 |
| 1,925,676 | 9/1933 | Richardson | 194/63 X |
| 1,960,065 | 5/1934 | Richardson et al. | 194/63 X |
| 2,432,561 | 12/1947 | DeMott | 221/273 X |
| 4,034,840 | 7/1977 | Reitman | 194/1 G X |

*Primary Examiner*—F. J. Bartuska

*Attorney, Agent, or Firm*—D. Paul Weaver

[57] ABSTRACT

The coin receiving capacity of a coin controlled mechanism is increased to compensate for increased cost of merchandise dispensed from a known type of vending machine whose coin holding capacity has been increased for the same reason. The mechansim has also been rendered more convenient and more reliable in operation and the number of parts in the mechanism has been significantly reduced without loss of essential function. Continuous turning of the dispensing knob in one direction has been made possible in lieu of forward and reverse turning required with the unimproved mechanism. The improved mechanism is fully compatible with existing vending machines in the field.

10 Claims, 15 Drawing Figures

FIG.5
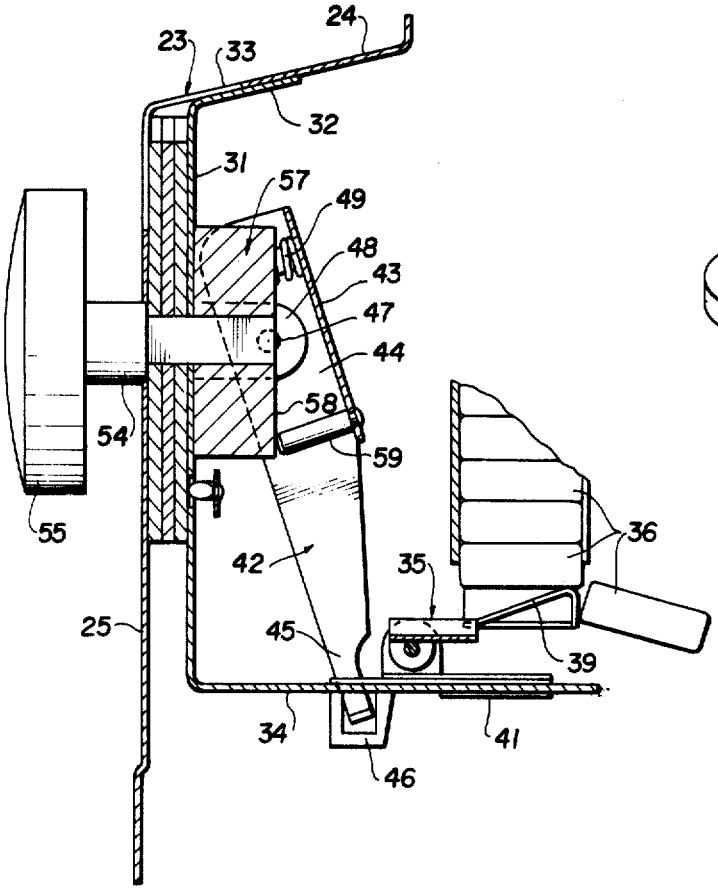
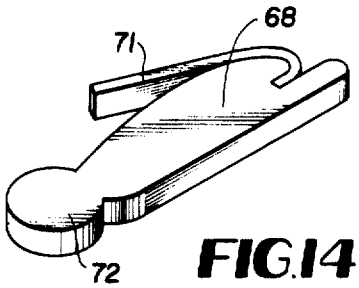
FIG.14
FIG.15
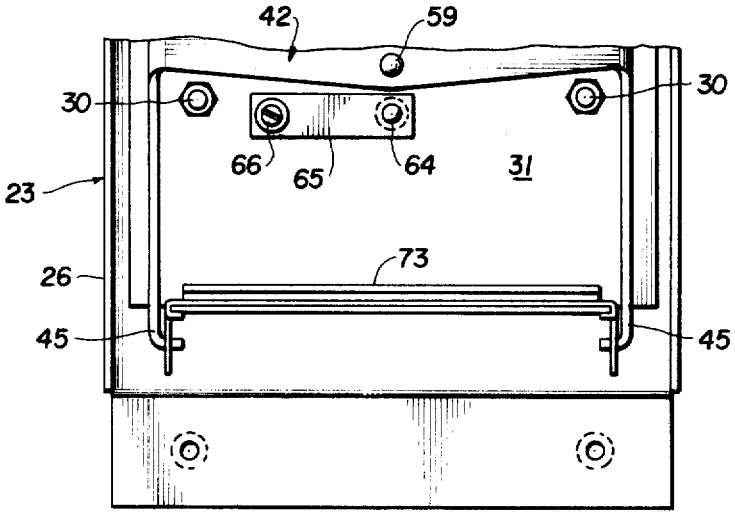

FIG.7
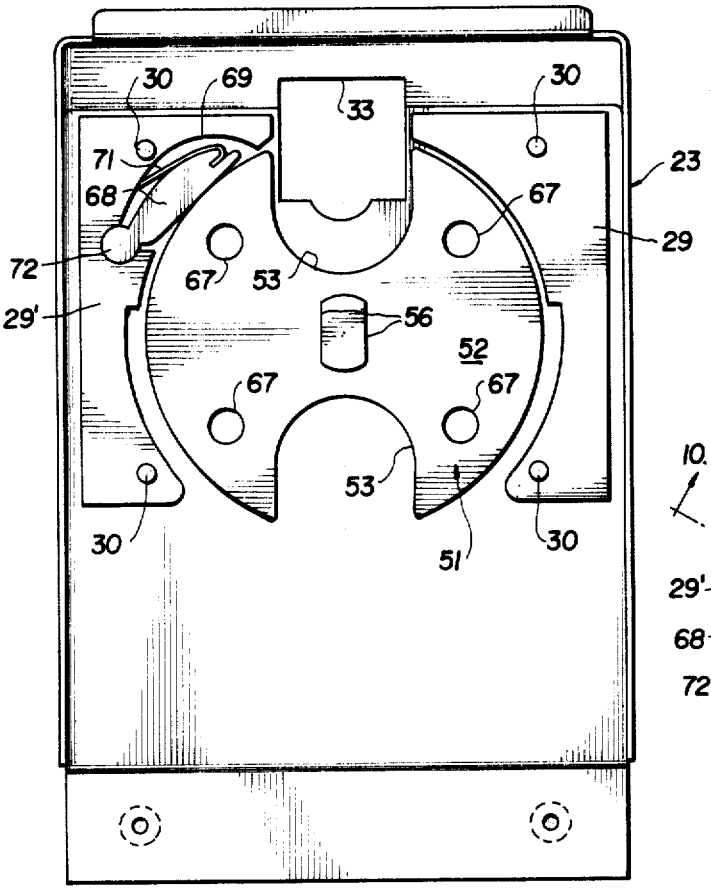
FIG.8
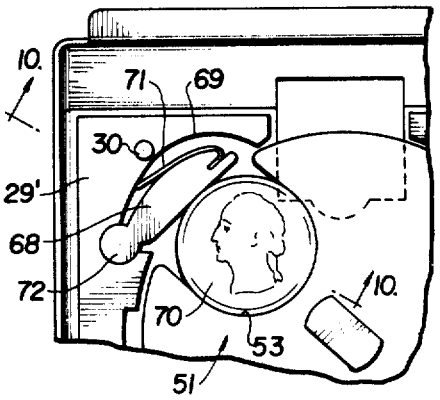
FIG.9
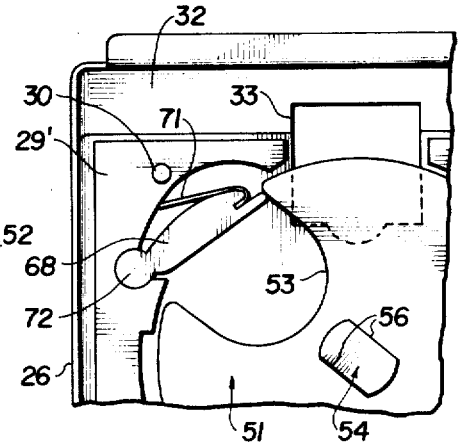
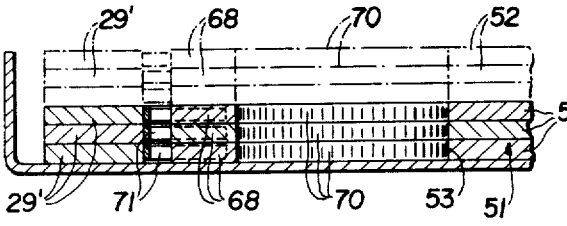
FIG.10

COIN CONTROLLED MECHANISM FOR VENDING MACHINE

CROSS-REFERENCE TO RELATED APPLICATION

This application contains common subject matter with application Ser. No. 210,224, filed Nov. 25, 1980, for PRODUCT DISPENSER HAVING INCREASED COIN HOLDING CAPACITY.

BACKGROUND OF THE INVENTION

The above patent application discloses a coin box of increased coin holding capacity for a dispensing machine for certain merchandise whose price has drastically increased in recent times.

The present invention seeks to provide an improved and simplified coin controlled mechanism for the same dispensing machine which is compatible with the enlarged capacity coin box. The improved mechanism can accept an increased number of coins of a required denomination, such as quarters, and possesses a more direct and convenient mode of operation while being more secure and reliable and of lesser manufacturing cost.

The broad class of vending machine and coin mechanism involved in the present application is shown in U.S. Pat. Nos. 1,043,374; 1,925,676; 1,960,065 and others.

Among the specific advantages achieved by the present invention is the ability of the mechanism to operate in response to turning of its control knob continuously in one direction, namely, clockwise or to the right, instead of with forward and reverse turning, as in the prior art.

Another achieved objective is the provision of a coin mechanism which is more difficult to defeat by someone attempting to cheat the machine. This is achieved in part through the provision of a simplified and effective anti-reverse device which blocks retrograde movement of the coin transport disc or wheel.

Additionally, a number of non-essential prior art components have been eliminated from the improved mechanism without any loss of essential function. The more simplified mechanism, in addition to being more convenient and economical, is more reliable in operation and sturdier than prior art mechanisms, requiring less adjustment and maintenance.

Other features and advantages of the invention will become apparent to those skilled in the art during the course of the following description.

BRIEF DESCRIPTION OF THE DRAWINGS

FIG. 5 is a view similar to FIG. 4 showing the mechanism in a product dispensing mode.

FIG. 7 is a similar elevational view of the mechanism with the rotary cam and back plate removed.

FIG. 8 is a fragmentary elevational view, similar to FIG. 7, depicting coin detector dogs in contact with coins in the coin transport disc.

FIG. 9 is a view similar to FIG. 8 showing the dogs resisting turning of the disc when proper coins are absent.

FIG. 10 is an enlarged fragmentary section taken on line 10—10 of FIG. 8.

FIG. 14 is a perspective view of a detector dog.

FIG. 15 is a fragmentary elevational view similar to FIG. 2 of a single column merchandise ejector or pusher according to a variation of the invention.

DETAILED DESCRIPTION

Figure 1:
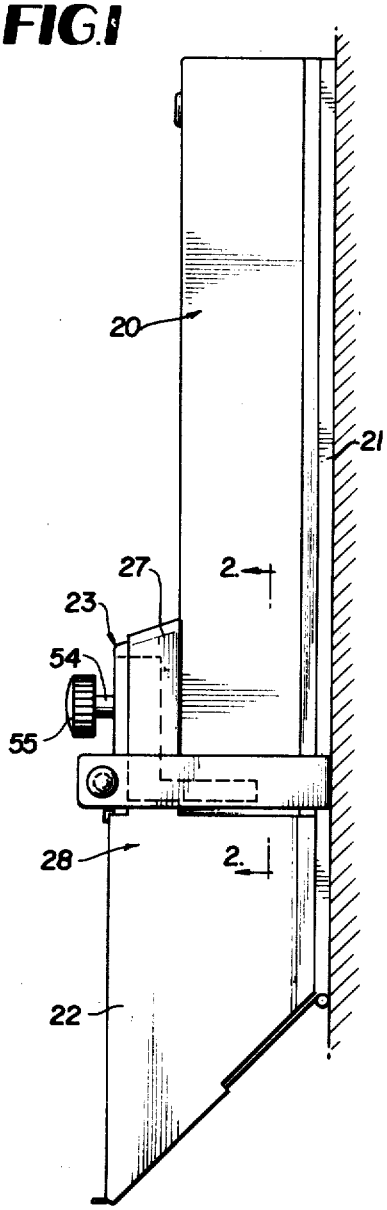
FIG. 1 is a side elevation of a merchandise dispenser equipped with the coin controlled mechanism forming the subject matter of this invention.
Figure 2:
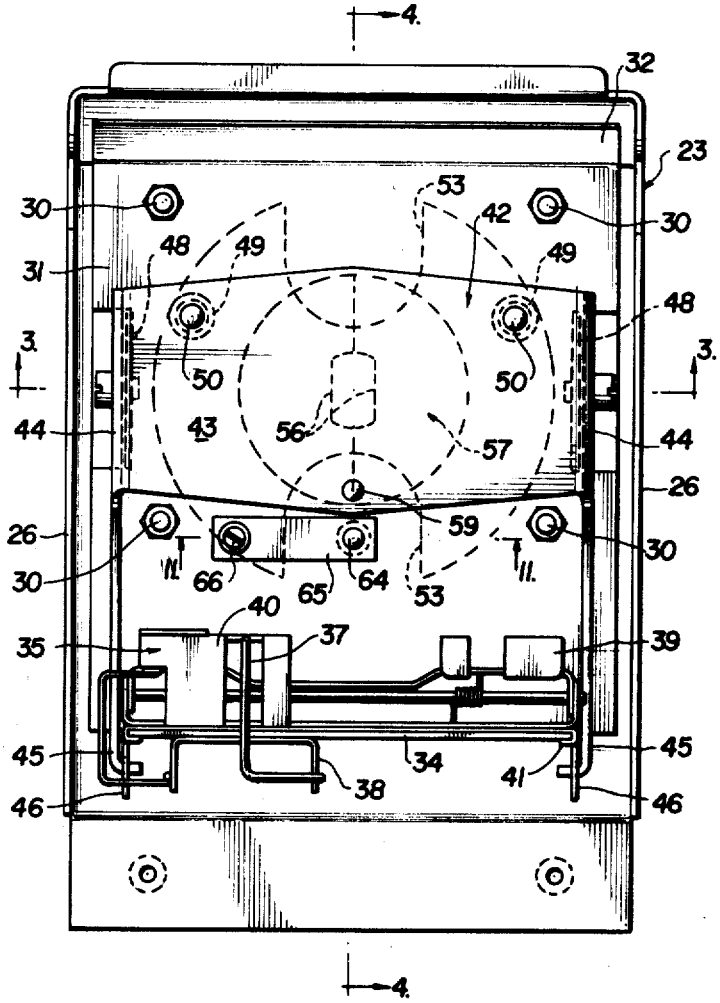
FIG. 2 is a rear elevation of the coin controlled mechanism separated from the dispenser on an enlarged scale, taken on line 2—2 of FIG. 1.
Figure 3:
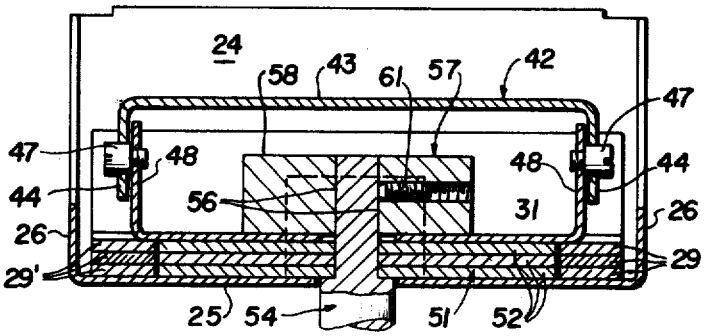
FIG. 3 is a horizontal section taken on line 3—3 of FIG. 2 with parts omitted.

Referring to the drawings in detail wherein like numerals designate like parts, there is shown in FIG. 1 a wall mounted vertically elongated merchandise dispenser 20 including a permanent wall-attached mounting plate 21 and a downwardly tapering coin box 22 extending below the lower end of the mounting plate 21 to provide increased coin holding capacity as described in the above-referenced patent application. The numeral 23 designates an improved and simplified coin controlled mechanism according to the invention which has a coin receiving and transporting capacity compatible with the enlarged coin box 22.

The mechanism 23 comprises a partial housing and support including a sloping top wall 24, a flat vertical front wall 25 and side flanges 26. As shown in FIG. 1, this partial housing abuts the front vertical wall of dispenser 22 and is protected by an upper strap portion 27 of a coin box guard 28, as fully disclosed in the referenced application.

Figure 4:
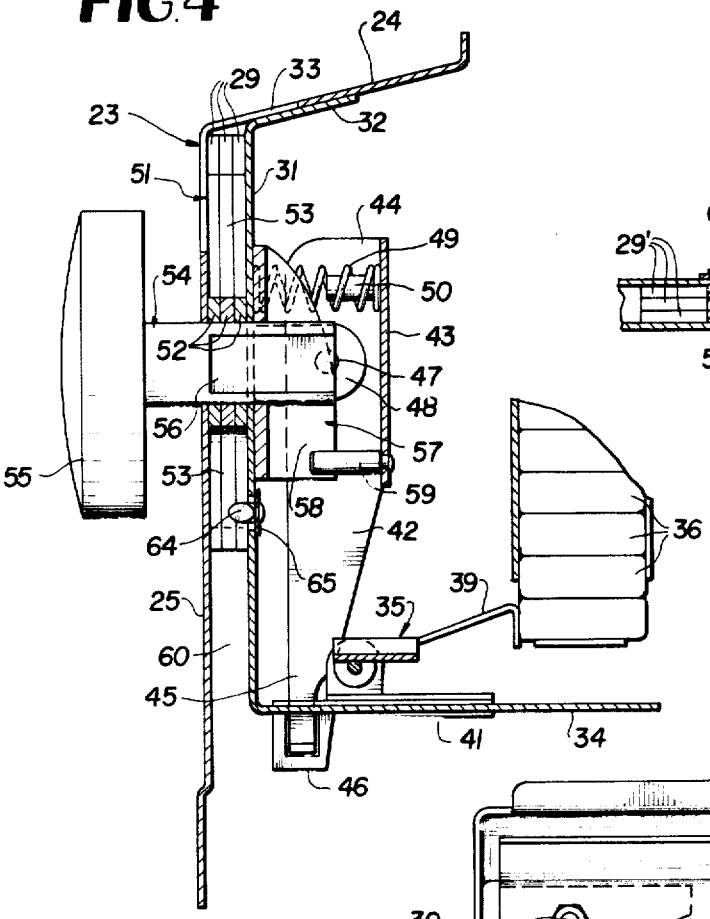
FIG. 4 is a vertical section taken on line 4—4 of FIG. 2.

The coin mechanism additionally comprises plural equal thickness spacer plates 29 and 29' at each side and upper corner of the partial housing in stacked relationship and secured near their tops and bottoms by bolts 30. A mechanism vertical back plate 31 abuts the rearmost pair of spacer plates, FIG. 4, and is anchored in the assembly by the same bolts 30 which anchor the spacer plates. Preferably, the top of back plate 31 carries an inclined extension 32 which serves as an adjustable partial closure for a coin receiving opening 33 formed in front wall 25 and top wall 24 of the partial housing.

The spacer plates 29 are the exact thickness of a specified coin, such as a quarter. Therefore, the number of spacer plates employed, such as two, three or four, will determine the number of coins which can be placed into the mechanism at one time. The present drawing illustration is for three quarters at a time to be introduced through the opening 33 of the mechanism. The back plate extension 32 will therefore block the introduction of a greater number of coins. If a greater or lesser number of spacer plates 29 and 29' are used, the back plate 31 will always abut the rearmost spacer plates and the extension 32 will always serve to block the introduction of more than the correct number of coins dictated by the number of spacer plate pairs, because the extension 32 will always be adjusted as the back plate 31 is relocated. If desired, the extension 32 may be an element formed separately from the back plate 31.

At its lower end, the vertical back plate 31 carries an integral horizontal rearwardly projecting platform plate 34 forming a horizontal guideway for a conventional dual column product pusher mechanism 35 of the kind described in U.S. Pat. No. 1,925,676. Since this pusher mechanism is conventional, it need not be fully described herein. Briefly stated, the merchandise units 36 in the dispenser 20 are frequently in two vertical columns. The units 36 are delivered to a customer through an outlet at the bottom of the coin box structure. When the coin controlled mechanism 23 is operated with proper coins to dispense a merchandise unit, such unit is dispensed from the bottom of the particular column being depleted. The dual column pusher mechanism 35 operates in such a manner that all of the units 36 in one merchandise column will be dispensed prior to the dispensing of units in the second column, as fully described in U.S. Pat. No. 1,925,676.

A sensing element 37 pivoted to a channel member 38 on the bottom of platform plate 34 senses the presence of remaining product units 36 in the first column of the dispenser until all of the units in that column are dispensed, after which the sensing element 37 rises responsive to a depleted first column and allows elevation of a second column pusher element 39 to an active dispensing position. The first column pusher element 40 remains at a constant elevation. Both pusher elements 40 and 39 form parts of the conventional mechanism 35 which includes a slide structure 41 mounted on platform plate 34 and movable rearwardly and forwardly thereon under influence of a rockable cam lever 42.

Cam lever 42 includes a plate body 43 carrying side flanges 44 which have depending arm extensions 45 operatively connected with depending loops 46 on the pusher mechanism slide structure to drive the latter along platform plate 34.

The cam lever side flanges are pivoted through shoulder screws 47 to a pair of rearwardly projecting apertured lugs 48 integrally formed on vertical back plate 31 in spaced parallel relationship. Biasing coil springs 49 engage over studs 50 on plate body 43 with their opposite ends bearing on back plate 31. These springs serve to bias the cam lever 42 to a substantially vertical non-dispensing position, FIG. 4, where the pusher mechanism 35 is retracted and inactive.

A laminated coin transport wheel 51 consisting of plural equal thickness plates 52 having the same thickness as spacer plates 29 and 29' is provided. This wheel has a pair of diametrically opposed coin transport pockets 53 formed therein through the several plates 52 forming the wheel. Each of the pockets 53 is alignable with the opening 33 in the mechanism partial housing between the pairs of spacer plates 29 and 29', FIG. 7. The number of plates 52 in the coin transport wheel may be increased or decreased to accommodate more or fewer coins, such as quarters, delivered through the opening 33.

The transport wheel 51 is mounted on a horizontal axis rotary shaft 54 having an operating knob 55 of convenient size at the front of the mechanism 23. The shaft 54 has a milled portion forming parallel flats 56 on opposite sides of the shaft. This portion of the shaft 54 is received through openings of like cross sectional shape in the plates 52 which make up the coin transport wheel 51 whereby such wheel is positively keyed to the rotary shaft with precision.

Figure 12:
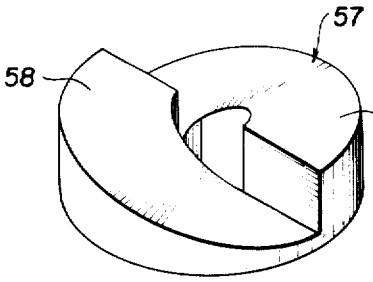
FIG. 12 is a perspective view of a two lobe cam.

Similarly keyed to the shaft 54 immediately rearwardly of the coin transport wheel and turning therewith in unison is a cam 57 having two lobes 58, as best shown in FIG. 12. In response to rotation of the cam 57 with shaft 54, the lobes 58 in succession will engage and act on a rigid follower pin 59 fixed to plate body 43. Each such engagement will produce rocking of the cam lever 42 to its merchandise dispensing position shown in FIG. 5 so that the bottom-most product unit 36 in the particular column being acted on will be dispensed to the customer.

Assuming that each unit 36 costs 75¢, three quarters at a time are placed in one transport pocket 53 of wheel 51 followed by turning of the knob and wheel by the customer to the right or clockwise as viewed by the customer one-half turn or 180 degrees. This will deliver the three quarters to a vertical passage 60 below the transport wheel and between the front wall 25 and back plate 31, from which passage the coins will fall by gravity into the coin box 22. Simultaneously, one cam lobe 58 will act on the pin 59 and rock the lever 42 to the position of FIG. 5 for pushing and dispensing one product unit 36 to the customer. Three more quarters can now be placed in the other pocket 53 of transport wheel 51 which is now topmost and adjacent the opening 33. Another half turn of the knob 55 in the same direction will deliver three more quarters into the coin box and will also deliver the next product unit 36 to the customer. A characteristic of the mechanism is that the knob 55 is always turned in the same direction to operate the machine and is never turned forwardly and then rearwardly as in the prior art. The cam 57 is fixed detachably on the shaft 54 by a set screw 61 or by some other suitable form of retainer.

Figure 13:
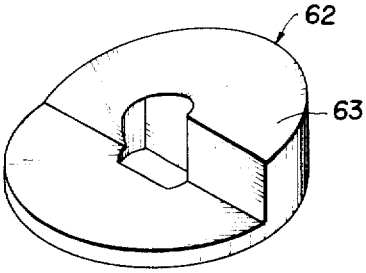
FIG. 13 is a similar view of a single lobe cam in accordance with a variation of the invention.

In some cases, a cam 62, FIG. 13, having only a single lobe 63 instead of the two lobes 58 can be utilized. When this is done, the mechanism can be converted to vend merchandise units 36 for double the amount of money which each pocket 53 of coin transport wheel 51 is constructed to accept. When set for three quarters, this amount is placed in one pocket 53 and the knob 55 is turned half a turn, after which three more quarters are placed in the second pocket, followed by another half turn of the knob to dispense the unit 36 to the customer.

Figure 11:
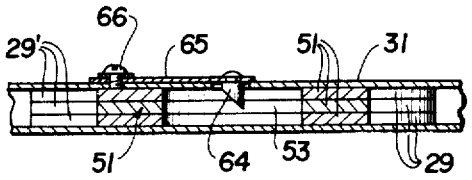
FIG. 11 is a similar section taken on line 11—11 of FIG. 2.
Figure 6:
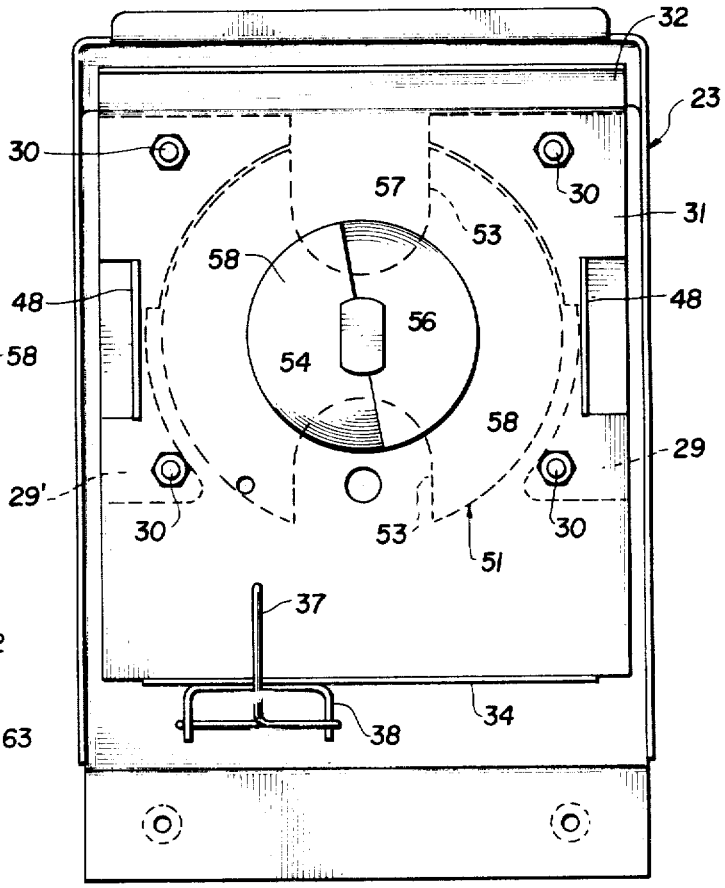
FIG. 6 is an elevational view similar to FIG. 2 with the cam lever and associated elements removed.

A simple and effective anti-reverse device is provided for the mechanism. This device shown in FIG. 11 comprises a beveled detent 64 carried by a leaf spring 65 attached at 66 to the back plate 31. When a customer turns the coin transport wheel 51 in the proper direction, the beveled face of detent 64 engages and passes over the edges of pockets 53 and stop openings 67, FIG. 7, provided in the wheel 51 at spaced intervals on a circle intersecting the beveled detent 64. FIG. 11 shows the detent 64 within a pocket 53 of the wheel 51. When in such pocket or in any of the openings 67, the detent 64 will effectively block reverse turning of the wheel 51 by knob 55 by contact of the unbeveled side thereof with the oncoming edge of the pocket 53 or opening 67.

The mechanism further includes spring-urged coin sensing dogs 68 near one upper corner thereof, within a cavity 69 formed in stacked spacer plates 29'. The dogs 68 are the same in number as the plates 29' and have the same thickness as the spacer plates and the same thickness as coins 70, such as quarters, being transported in one of the pockets 53 of wheel 51. The dogs 68 are biased inwardly toward the coins by leaf springs 71. The dogs have integral pivot elements 72 which are received in arcuate recesses of spacer plates 29'.

When proper coins are present in the oncoming pocket 53, FIG. 8, such as three quarters, the peripheries of the coins 70 will tangentially engage the dogs 68 and urge them outwardly beyond the periphery of wheel 51 so that the latter can rotate beyond the sensing dogs. If one or more coins is missing or if coins or slugs of improper size are used, the dog or dogs 68 under influence of its spring 61 will swing inwardly and into the path of movement of one side wall of the oncoming pocket 53, FIG. 9, to thereby positively block continued rotation of the coin transport wheel.

FIG. 10 shows in phantom lines how greater numbers of coins can be accommodated when required by correspondingly increasing the number of plates 52 in wheel 51, the number of spacer plates 29 and 29', and the number of dogs 68.

While the mechanism has been described with relation to a two column dispenser where the merchandise 36 in one column is depleted before dispensing from the second column begins, it should be understood that the mechanism can be constructed for use with dispensers which have only a single column of merchandise. The single pusher arrangement is indicated at 73 in FIG. 15 which shows this variant. In either case, the platform plate 34 in addition to guiding the pusher means under influence of the rockable lever 42 forms a merchandise support prior to the pushing off operation. The basic operation of the mechanism is the same regardless of whether a two column or single column pusher means is employed.

It should now be clear to those skilled in the art that the mechanism is able to satisfy the requirement of greater coin handling capacity necessitated by the rising cost of the merchandise. It therefore matches the capacity of the enlarged coin box 22 and like the coin box can still be used on the standard dispenser 20 without altering the basic structure of the latter. The invention is also characterized by great simplicity, convenience of use, high reliability and comparative economy of manufacture.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A coin mechanism for a merchandise dispenser having at least a single merchandise column from which merchandise units are dispensed one at a time from the bottom of the column, the coin mechanism comprising a supporting body portion adapted for attachment to a merchandise dispenser, a unitary combined vertical back plate, horizontal platform and guide and upper coin blocking plate secured to said body portion, the body portion having an upper coin receiving opening above said blocking plate, a pocketed coin transport wheel including plural equal thickness plate sections between said back plate and a front wall portion of the supporting body portion, fixed spacer plates of equal thickness and corresponding in number and thickness to the plate sections of said wheel on opposite sides of said wheel and coin receiving opening and disposed between said back plate and said wall of the supporting body portion, a corresponding number of spring-urged coin sensing dogs associated with the spacer plates on one side of said wheel operable to sense the presence or absence of proper coins in pockets of said wheel and to block rotation of the wheel when proper coins are absent, a manual rotational drive shaft for said wheel coupled therewith and extending exteriorly of the supporting body portion, a lobed cam secured to the drive shaft and turning therewith and disposed adjacent to the surface of said back plate away from said wheel, a rockable cam lever including a cam follower element in the rotational path of the lobed cam, pivot means for said cam lever including a pair of spaced apertured lugs on opposite sides of said back plate and formed integral therewith, merchandise pusher means operatively connected with the cam lever and having guided engagement with said horizontal platform and guide, spring biasing means for the cam lever urging it to an upright non-dispensing position and including a pair of coil springs and spring locator elements on one side of said pivot means and between said back plate and a wall of the cam lever, and an anti-reverse device for said coin transport wheel including a beveled detent, a leaf spring carrying the detent and a fastener anchoring the leaf spring to said back plate, said wheel having spaced openings to coact with the beveled detent whereby the latter permits rotation of the wheel in one direction but blocks reverse rotation thereof.

2. A coin mechanism for a merchandise dispenser of the type having at least a single merchandise column from the bottom of which merchandise units are dispensed one at a time, said coin mechanism comprising a supporting body portion adapted for attachment to a dispenser, a combined unitary back plate and platform fixed to the body portion with the back plate spaced from a front wall of the body portion, a pocketed coin transport wheel disposed between said back plate and said front wall, a manual rotational drive shaft means for said wheel operable from the front of said body portion, a spring-urged anti-reverse blocking element for said wheel on said back plate, a lobed cam fixed to the drive shaft means at the side of the back plate away from said wheel, a cam lever rockably mounted on the unitary back plate and platform including a follower element in the path of movement of the cam, compressive coil spring return means for the cam lever between the cam lever and back plate, and a merchandise pusher slidably engaged with the platform and drivingly coupled with the end of the cam lever away from said coil spring return means.

3. A coin mechanism for a merchandise dispenser as defined in claim 2, and said pocketed coin transport wheel having a pair of diametrically opposite peripheral coin pockets, and said cam having a pair of diametrically spaced lobes thereon, whereby placement of proper coins in each pocket of the wheel followed by half turn rotation of the wheel in one direction only will serve to dispense a merchandise unit to a customer operating the mechanism.

4. A coin mechanism for a merchandise dispenser as defined in claim 2, and said cam having a single lobe only, whereby placement of proper coins in succession in each of said pockets and two half turns of said wheel in one direction only will serve to dispense a merchandise unit to a customer operating the mechanism.

5. A coin mechanism for a merchandise dispenser as defined in claim 2, and a blocking plate extension for coins at the top of said back plate in underlying relationship to a coin receiver opening at the top of said supporting body portion.

6. A coin mechanism for a merchandise dispenser as defined in claim 5, and said wheel being formed of plural equal thickness plate sections whose numbers may be varied to thereby vary the spacing of the back plate and said blocking plate extension from the front wall of said supporting body portion, and variable plural spacer plate means on opposite sides of said wheel between said back plate and said front wall, and fastener means common to said front wall, back plate and spacer plate means for attaching the same fixedly in assembled relationship.

7. A coin mechanism for a merchandise dispenser as defined in claim 2, and a pair of pivot lugs carried by opposite sides of the platform, and a pair of pivot elements secured to said lugs in coaxial relationship and defining the rocking axis of said cam lever.

8. A coin mechanism for a merchandise dispenser as defined in claim 2, and said anti-reverse blocking element comprising a beveled blocking pin, a leaf spring carrying the pin and biasing it toward one face of said wheel and a fastener anchoring the leaf spring to said back plate, said wheel having a series of blocking openings formed therein on a circle which intersects the axis of said pin.

9. A coin mechanism for a merchandise dispenser as defined in claim 2, and said drive shaft means including a shaft having at least one flat formed thereon, said wheel and lobed cam having coaxial openings receiving the drive shaft and each having a coacting flat, and a knob for turning the drive shaft secured thereto exteriorly of the mechanism.

10. A coin mechanism for a merchandise dispenser as defined in claim 2, and said compressive coil spring return means comprising a pair of spaced parallel axis coil springs near opposite sides of the cam lever, and a pair of fixed locator studs for said springs projecting from an upright wall of the cam lever and entering said springs.

* * * * *